US007465361B2

(12) United States Patent
Terashima et al.

(10) Patent No.: US 7,465,361 B2
(45) Date of Patent: Dec. 16, 2008

(54) METHOD FOR PRODUCING GRAIN ORIENTED MAGNETIC STEEL SHEET AND GRAIN ORIENTED MAGNETIC STEEL SHEET

(75) Inventors: Takashi Terashima, Chiyoda-ku (JP); Minoru Takashima, Chiyoda-ku (JP); Yasuyuki Hayakawa, Chiyoda-ku (JP)

(73) Assignee: JFE Steel Corporation (JP)

( * ) Notice: Subject to any disclaimer, the term of this patent is extended or adjusted under 35 U.S.C. 154(b) by 500 days.

(21) Appl. No.: 10/530,839

(22) PCT Filed: Oct. 27, 2003

(86) PCT No.: PCT/JP03/13692

§ 371 (c)(1),
(2), (4) Date: Apr. 8, 2005

(87) PCT Pub. No.: WO2004/040024

PCT Pub. Date: May 13, 2004

(65) Prior Publication Data

US 2006/0076086 A1 Apr. 13, 2006

(30) Foreign Application Priority Data

Oct. 29, 2002 (JP) ..... 2002-314055

(51) Int. Cl.
*H01F 1/147* (2006.01)

(52) U.S. Cl. ..... 148/111; 148/110; 148/112

(58) Field of Classification Search ..... None
See application file for complete search history.

(56) References Cited

U.S. PATENT DOCUMENTS

| | | | | |
|---|---|---|---|---|
| 4,225,366 | A | 9/1980 | Harase et al. | |
| 6,153,019 | A | 11/2000 | Espenhahn et al. | |
| 2001/0030001 | A1 * | 10/2001 | Hayakawa et al. | 148/111 |
| 2003/0116236 | A1 * | 6/2003 | Hayakawa et al. | 148/516 |

FOREIGN PATENT DOCUMENTS

| | | | |
|---|---|---|---|
| EP | 0 535 651 | A1 | 4/1993 |
| EP | 535651 | A1 | 4/1993 |
| EP | 0 607 440 | A1 | 7/1994 |
| EP | 607440 | A1 | 7/1994 |
| EP | 1 004 680 | A1 | 5/2000 |
| JP | 2001-107147 | A | 4/2001 |
| JP | 2001-107147 | A | 4/2001 |
| JP | 2003-49250 | A | 2/2003 |
| KR | 1996-7161 | B1 | 7/1996 |

OTHER PUBLICATIONS

Partial Translation of Korean Patent Publication No. 1993-7161.*

* cited by examiner

*Primary Examiner*—John P. Sheehan
(74) *Attorney, Agent, or Firm*—DLA Piper LLP (US)

(57) ABSTRACT

In a method for manufacturing a grain-oriented electrical steel sheet using steel containing less than 100 ppm of Al and 50 ppm or less each of N, S, and Se as a starting material, purification annealing is performed at 1050° C. or more, the partial pressure of hydrogen in the atmosphere being adjusted to 0.4 atm or less in a temperature range above 1170° C. for a purification annealing conducted at a temperature above 1170° C., or 0.8 atm or less in a temperature range of 1050° C. or more for a purification annealing conducted at a temperature of 1170° C. or less, to prevent deterioration of the bend properties due to the impurities.

9 Claims, 1 Drawing Sheet

METHOD FOR PRODUCING GRAIN ORIENTED MAGNETIC STEEL SHEET AND GRAIN ORIENTED MAGNETIC STEEL SHEET

TECHNICAL FIELD

This disclosure relates to a grain-oriented electrical steel sheet with excellent magnetic and bend properties, and to a method for manufacturing the grain-oriented electrical steel sheet consistently. In particular, the disclosure provides an advantageous effect when a steel sheet is, but not limited to, strip-shaped or a steel strip.

BACKGROUND ART

Prior Art

In manufacturing a grain-oriented electrical steel sheet, a precipitate that is known as an inhibitor is generally used for preferential secondary-recrystallization of {110} <001>-oriented grain, which is called Goss-oriented grain during finishing-annealing.

For example, methods in which MnS or MnSe (Japanese Examined Patent Application Publication No. 51-13469) and AlN are used as inhibitors have already been put to practical use. Furthermore, BN and nitrides of Ti, Zr, and V are also known as inhibitors.

In conventional methods as described in Japanese Examined Patent Application Publication No. 51-13469, finishing-annealing typically includes secondary-recrystallization annealing and subsequent purification annealing for the purpose of film formation and purification.

While the secondary-recrystallization annealing can be performed in various atmospheres, it is believed that nitrogen-containing atmospheres are most suitable to stabilize the behavior of effective inhibitors, such as nitrides.

On the other hand, the purification annealing is typically performed in hydrogen-based atmospheres, preferably in a hydrogen atmosphere to enhance the removal of impurities in the steel, such as an inhibitor. In particular, a nitrogen as a component of the atmosphere is not preferred, because a high nitrogen content results in insufficient removal of nitrogen in the steel, and therefore little improvement in the magnetic property of the steel sheet can be achieved. For example, Japanese Unexamined Patent Application Publication No. 11-158557 describes the adverse effect of a nitrogen atmosphere (about 0.1-0.4 atm) in the purification annealing.

In general, the purification annealing is preferably performed at 1180° C. or more. The purification annealing below 1180° C. results in insufficient removal of impurities in the steel, such as S and Se, and leads to inferior bend properties of the steel sheet.

The bend properties are evaluated by a repeated bending test in accordance with JIS C 2550; a specimen 30 mm in width that is cut from a steel sheet is repeatedly bent at right angles under tension and the number of bendings is counted until a crack penetrates through the specimen in the thickness direction.

Although methods including the use of inhibitors are useful to consistently develop secondary-recrystallization grain, they require fine dispersion of precipitates and thus a slab must be heated to at least 1300° C. before hot rolling.

However, heating the slab to such a high temperature disadvantageously (1) increases equipment cost, (2) reduces yields owing to an increased amount of scale during hot rolling, and (3) complicates maintenance of facilities.

In contrast to these methods, methods for manufacturing a grain-oriented electrical steel sheet without using inhibitors are disclosed in Japanese Unexamined Patent Application Publication Nos. 64-55339, 2-57635 and 7-197126.

All the methods in Japanese Unexamined Patent Application Publication Nos. 64-55339, 2-57635 and 7-197126 preferentially develop a {1 110} surface by using surface energy as a driving force. Thus, impurities in the steel sheet are reduced in advance and then finishing-annealing at high temperature is performed in a controlled atmosphere to prevent the generation of surface oxides to enhance secondary-recrystallization.

For example, Japanese Unexamined Patent Application Publication No. 64-55339 describes a technique for preparing an integrated recrystallized structure with {110} <001> orientation, in which a silicon steel sheet prepared by melting highly purified raw materials, such as electrolytic iron, is rolled to a thickness of 0.2 mm or less, and is then heat-treated at 1180° C. or more in vacuo or in an atmosphere of an inert gas, hydrogen, or a mixture of hydrogen and nitrogen.

Japanese Unexamined Patent Application Publication No. 2-57635 describes a technique in which a commercial silicon steel strip is coated with an annealing separator to remove impurities, such as AlN and MnS, is purified at 1100-1200° C. under a hydrogen atmosphere for 3 hours or more, is cold-rolled to a thickness of 0.15 mm or less, and is then subjected to secondary-recrystallization annealing at 950-1100° C. in an atmosphere of an inert gas such as Ar, hydrogen, or a mixture of hydrogen and an inert gas, and preferably under reduced pressure.

In Japanese Unexamined Patent Application Publication No. 7-197126, silicon steel in which S, an impurity having a particularly large adverse effect, is reduced to 10 ppm, is subjected to short-time finishing-annealing at 1000-1300° C. in a nonoxidative atmosphere with an oxygen partial pressure of 0.5 Pa or less, or in vacuo for 10 minutes or less.

These techniques do not place importance on purification annealing after secondary-recrystallization and do not particularly disclose it.

The above-mentioned manufacturing processes that utilize surface energy do not require as high a temperature as the conventional methods used to heat the slab, but they have the following problems:

First, for effective use of the surface energy difference, the thickness of a steel sheet must be small to increase the contribution of the surface. For example, in the techniques disclosed in Japanese Unexamined Patent Application Publication Nos. 64-55339 and 2-57635 the thicknesses of the steel sheets are limited to not more than 0.2 mm and 0.15 mm, respectively.

However, most of the currently-used grain-oriented electrical steel sheets are 0.20 mm or more in thickness, and thus it is difficult to manufacture a grain-oriented electrical steel sheet with excellent magnetic properties using the surface energy.

Second, as described above, an atmosphere of an inert gas or hydrogen, and preferably a vacuum is required for finishing-annealing for the secondary-recrystallization. However, the combination of high temperature and a vacuum is very difficult to achieve and expensive in facilities.

Third, the use of the surface energy, in principle, only allows for the selection of a {110} surface, and does not necessarily allow for the development of <001>-oriented Goss grain along a rolling direction.

Since the magnetic property of the grain-oriented electrical steel sheet can be improved only when the axis of easy magnetization <001> is oriented toward the rolling direction, selection of only the {110} surface, in principle, does not provide a satisfactory magnetic property. Thus, the rolling and annealing conditions which can achieve excellent magnetic properties in methods utilizing the surface energy are limited and the resulting magnetic properties will most likely be unstable.

Fourth, of the methods utilizing the surface energy, the finishing-annealing must be performed while inhibiting the formation of a surface oxide layer, and thus cannot be performed when an annealing separator is applied to a steel sheet. Thus, unlike typical grain-oriented electrical steel sheets, an oxide film cannot be formed after the finishing-annealing. A forsterite film, which is formed when a MgO-based annealing separator is applied to the steel sheet, for example, generates tension on the surface of the steel sheet to improve iron loss. In addition, phosphate-based insulating tension-coating on the forsterite film ensures adhesion of the coating and further improves iron loss. Therefore, the absence of a forsterite film on the steel sheet results in poor adhesion between the tension-coating and the steel sheet, and the iron loss increases significantly.

Under these circumstances, in Japanese Unexamined Patent Application Publication Nos. 2000-129356 and 2000-119824, we proposed techniques for developing a Goss-oriented crystal grain during secondary-recrystallization of materials that do not contain an inhibitor by controlling the difference in the grain boundary mobility (details are shown below). Using these techniques, crystal grain can be brought into Goss orientation without using surface energy, thus overcoming the problems described above. For example, since these techniques are not limited by the surface condition of the steel sheet, an annealing separator can be applied to the steel sheet before finishing-annealing to form a film, such as a forsterite film, and thereby iron loss can be improved. For convenience, the grain-oriented electrical steel sheet proposed in Japanese Unexamined Patent Application Publication No. 2000-129356 and the like is hereinafter referred to as inhibitor-free steel sheet.

In the technique proposed in Japanese Unexamined Patent Application Publication No. 2000-129356 and soon, since the Al content is reduced to a predetermined level and the S and Se contents are also limited, conventional purification annealing is not necessarily required and the steel sheet is simply heated to a temperature at which a film, such as a forsterite film, forms after the secondary-recrystallization annealing. For example, Japanese Unexamined Patent Application Publication No. 2000-129356 shows a finishing-annealing condition in which annealing is completed by heating the steel sheet to about 950-1050° C. at a rate of about 15-20° C./h in a nitrogen atmosphere or nitrogen-containing atmosphere.

However, purification anncaling is not necessarily precluded in the technique, and purification annealing that allows for further reduction of impurities in the steel is rather effective in further improving the magnetic properties. For example, Japanese Unexamined Patent Application Publication No. 2000-119824 discloses a technique in which the finishing-annealing is performed by heating the steel sheet to 1180° C. in a mixed atmosphere of 50% hydrogen and 50% nitrogen, and then by keeping the steel sheet at 1180° C. for 5 hours in a hydrogen atmosphere. Even if purification annealing is performed, the absence of inhibitors results in a reduced operating load. For example, purification annealing at a lower temperature can achieve a sufficient effect.

Furthermore, in some techniques, secondary-recrystallization annealing and purification annealing are indistinguishable from each other. For example, Japanese Unexamined Patent Application Publication No. 2000-119824 discloses a technique in which the finishing-annealing is performed by increasing the temperature to about 1100° C. at a rate of about 20° C./h in a mixed atmosphere of 50% hydrogen and 50% nitrogen, or by increasing the temperature to 1200° C. at a rate of 15° C./h in a hydrogen atmosphere.

Japanese Unexamined Patent Application Publication No. 2000-119823 describes a technique in which finishing-annealing is performed using steel that is free of inhibitors at about 1000-1150° C. in an atmosphere of, for example, nitrogen, Ar, hydrogen, 50% hydrogen and 50% nitrogen, 50% nitrogen and 50% Ar.

As described above, when impurities in steel, such as S and Se, are insufficiently removed, the bend properties will deteriorate. In an inhibitor-free steel sheet, the contents of S and Se after purification annealing should be low enough so as not to affect the bend properties. Nevertheless, it became apparent that a final sheet product of inhibitor-free steel might have deteriorated bend properties. Thus, this indicates the presence of another cause of deterioration in the bend properties, other than the insufficient removal of S and Se.

Poor bend properties may result in the fracture of the steel sheet in a punching line or the generation of cracks in the steel sheet in the production of a wound-core transformer. These problems may occur even when, for example, only a portion of an electrical steel strip in the transverse direction (for example, transverse end) has deteriorated bend properties.

Accordingly, it could be advantageous to improve the technique for manufacturing a grain-oriented electrical steel sheet without using inhibitors (inhibitor-free steel sheet) as disclosed in Japanese Unexamined Patent Application Publication No. 2000-129356 and the like to prevent deterioration in the bend properties.

SUMMARY

We provide the following aspects:

(1) A method for manufacturing a grain-oriented electrical steel sheet with excellent bend properties, comprising the steps of:

rolling a steel slab containing 0.08 mass percent or less of carbon, 2.0-8.0 mass percent of Si, and 0.005-3.0 mass percent of Mn into a cold-rolled steel sheet;

subsequently performing decarburizing annealing of the cold-rolled steel sheet if desired;

subsequently applying an annealing separator to the cold-rolled steel sheet if desired;

performing secondary-recrystallization annealing of the cold-rolled steel sheet; and subsequently performing purification annealing of the cold-rolled steel sheet, wherein the steel slab contains less than 100 ppm of Al and not more than 50 ppm each of N, S, and Se, the purification annealing is performed at 1050° C. or more, and the partial pressure of hydrogen in the atmosphere is adjusted to 0.4 atm or less in a temperature range above 1170° C. for a purification annealing conducted at a temperature above 1170° C., or 0.8 atm or less in a temperature range of 1050° C. or more for a purification annealing conducted at a temperature of 1170° C. or less.

Preferably, the annealing separator is a MgO-based annealing separator.

Preferably, the rolling step includes the substeps of hot-rolling the steel slab, annealing the hot-rolled steel sheet if desired, performing cold-rolling one time, or at least two times with intermediate annealing therebetween to produce the cold-rolled steel sheet.

Preferably, in the purification annealing, nitrogen in the atmosphere in which the hydrogen partial pressure is controlled is less than 50% by volume fraction.

(2) The method for manufacturing a grain-oriented electrical steel sheet with excellent bend properties according to aspect (1) and its preferred embodiment, wherein the steel slab further contains 0.005-1.50 mass percent of Ni and/or 0.01-1.50 mass percent of Cu.

(3) The method for manufacturing a grain-oriented electrical steel sheet with excellent bend properties according to aspect (1) or (2) and its preferred embodiments, wherein the steel slab further contains a total of 0.0050-0.50 mass percent of at least one of Cr, As, Te, Sb, Sn, P, Bi, Hg, Pb, Zn, and Cd, and the partial pressure of the hydrogen atmosphere is adjusted to 0.2 atm or less in a temperature range above 1170° C. for a purification annealing conducted at a temperature above 1170° C., or 0.6 atm or less in a temperature range of 1050° C. or more for a purification annealing conducted at a temperature of 1170° C. or less.

Preferably, the steel slab contains at least one of As, Te, Sb, Sn, P, Bi, Hg, Pb, Zn, and Cd.

(4) The method for manufacturing a grain-oriented electrical steel sheet with excellent bend properties according to any of aspects (1) to (3) and their preferred embodiments, and a strip-shaped grain-oriented electrical steel sheet (or a grain-oriented electrical steel strip) manufactured by the method, wherein the rolling includes a cold-rolling substep of preparing a cold-rolled steel strip, and the cold-rolled steel strip is subjected to secondary-recrystallization annealing and purification annealing to produce a strip-shaped grain-oriented electrical steel sheet.

(5) A strip-shaped grain-oriented electrical steel sheet containing 2.0-8.0 mass percent of Si, 0.005-3.0 mass percent of Mn, and 35 ppm or less of N, prepared through a finishing-annealing and a flattening step (including a substep of flattening annealing and a substep of applying tension-coating), wherein the number of bendings in accordance with JIS C 2550 is at least 6 over the transverse direction.

DETAILED DESCRIPTION

Figure 1:
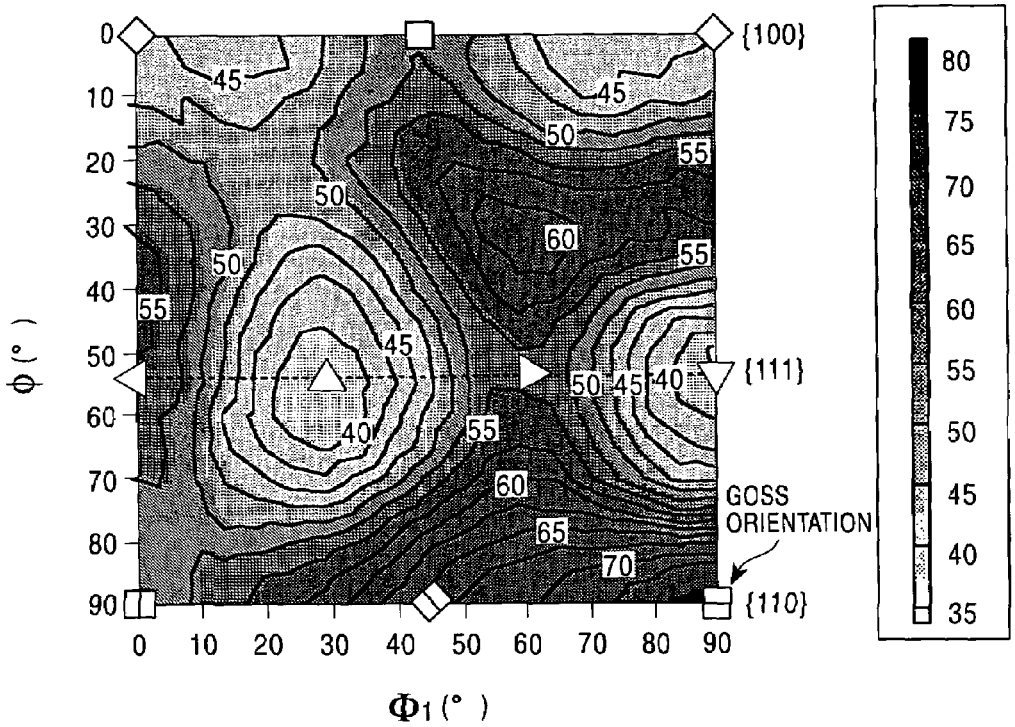
FIG. 1 is a diagram showing the percentage, relative to each oriented grain, of a grain boundary of which the disorientation angle before finishing-annealing is 20-45°.

We employ a method for promoting secondary-recrystallization without an inhibitor.

As a result of diligent investigation on preferential secondary-recrystallization of Goss-oriented grain, we discovered that a grain boundary which has a disorientation angle of 20-45° in a primary recrystallization structure plays an important role and reported this finding in Acta Material, 45, 1285 (1997).

Specifically, we analyzed the primary recrystallized texture just before secondary-recrystallization of a grain-oriented electrical steel sheet, and studied the percentage (mass percent) of a grain boundary which has a disorientation angle of 20-45° for each grain boundary around crystal grains that have different crystal orientations. FIG. 1 shows the results. The Euler space is expressed by a cross-section at $\Phi_2$=45° of Eulerian angles ($\Phi_1$,$\Phi$,$\Phi_2$). Major orientations including Goss orientation are illustrated.

FIG. 1 shows that the percentage of the grain boundary that has the disorientation angle of 20-45° is highest at the Goss orientation.

Experimental data by C. G. Dunn et al. (AIME Transaction, 188, 368 (1949)) suggested that the grain boundary that has a disorientation angle of 20-45° is a high-energy grain boundary. The high-energy grain boundary has a large area of free volume and disordered structure. Since grain boundary diffusion is a process in which atoms move through grain boundaries, it is faster in the high-energy grain boundary because of its larger area of free volume.

Secondary-recrystallization in the conventional methods is known to occur with diffusion-controlled growth and coarsening of a precipitate known as an inhibitor. Considering these findings, we believe that the precipitate on. the high-energy grain boundary grows preferentially during the finishing-annealing, and thereby pinning of the grain boundary in the Goss orientation is preferentially removed to initiate grain boundary movement, and thus Goss-oriented grain grows.

We further developed this study and reached the following conclusion.

In summary, in the conventional methods, Goss-oriented grain in a primary-recrystallized structure contains many high-energy grain boundaries, and the role of the inhibitor is to generate a difference in mobility between the high-energy grain boundary of Goss-oriented grain and other grain boundaries. Thus, if a difference in mobility is generated without using an inhibitor, it is possible to accumulate the Goss orientation during the secondary-recrystallization.

Initially, the high-energy grain boundary has a larger mobility than other grain boundaries. However, since impurities in steel tend to segregate at grain boundaries, particularly at the high-energy grain boundary, a large amount of impurities will reduce the difference in mobility between the high-energy grain boundary and other grain boundaries.

Accordingly, when materials are purified and the effects of impurities described above are removed, the original difference in mobility due to the grain boundary structure becomes obvious and Goss-oriented grain can be developed preferentially during the secondary-recrystallization.

This is the principle of manufacturing an inhibitor-free steel sheet.

In the inhibitor-free steel sheet, the purification annealing is also sometimes performed to remove residual impurities or to prepare, for example, a forsterite film. As mentioned above, even in this case, it was found that the bend properties may be deteriorated.

As a result of investigation as to the deterioration of the bend properties in the inhibitor-free steel sheet, it was found that an immediate cause was a reduction in the grain boundary strength associated with precipitation of silicon nitrides at the grain boundary.

This precipitation of silicon nitrides at the grain boundary is partly caused by nitrogen remaining in the steel after the purification annealing. Theoretically, it may be possible to overcome this problem by sufficient purification annealing. However, nonuniform purification in a coil limits this possibility.

In the conventional manufacturing processes using S or Se as an inhibitor, the inhibitor in the steel retards the formation of a film and thus nitrogen in the steel is easily purified. On the other hand, in the inhibitor-free steel sheet, which originally contains fewer impurities, a dense film is easily formed and therefore nitrogen in the steel is difficult to remove. Accordingly, a new method for preventing silicon nitrides from precipitating at the grain boundary is desired.

Further investigation of the coil showed that the bend properties were deteriorated only at the transverse ends, even when the amounts of nitrogen remaining at transverse ends and the transverse center of the coil are similar. The term "end" of the coil used herein means an area between an endmost position and an inner position about 100 mm from the endmost position in the coil.

In other words, it might be possible to improve the bend properties by preventing silicon nitrides from precipitating at the grain boundary, even when nitrogen in the steel is insufficiently removed. As a result of diligent investigation, we have discovered that by controlling the hydrogen partial pressure depending on the annealing temperature during the purification annealing, precipitation of silicon nitrides at the grain boundary can be prevented while nitrogen remains in the steel.

Although the reason the precipitation of silicon nitrides at the grain boundary is prevented is not clear, we believe the reason as follows:

Annealing of a steel sheet at high temperature in a hydrogen atmosphere induces hydrogen attack, which embrittles a grain boundary of the secondary-recrystallization grain; that is, microvoids or fissures are formed at the grain boundary. Since these microvoids or fissures have exposed metal surfaces, silicon nitrides precipitate preferentially on the exposed metal surface, that is, in microvoids or fissures of the grain boundary when the temperature decreases during the purification annealing. The involvement of hydrogen attack is supported by the findings that a portion with deteriorated bend properties extends as a hydrogen attack promoter such as Sb increases in the steel.

In other words, purification annealing at high temperature and high hydrogen partial pressure enhances the grain boundary precipitation of silicon nitrides. Thus, the bend properties can be improved by avoiding these conditions.

Each constituent feature of the method for manufacturing the electrical steel sheet will be described below.

First, a material for the electrical steel sheet (typically, a steel slab) contains about 0.08 mass percent or less of carbon, about 2.0-8.0 mass percent of Si, and about 0.005-3.0 mass percent of Mn, and also contains reduced amount of following elements; about 100 ppm or less of Al, and about 50 ppm or less (mass ppm; the same shall apply hereinafter) each of N, S and Se.

Carbon content: about 0.08 mass percent or less

When the carbon content in the material exceeds about 0.08 mass percent, even if the material is subjected to decarburizing annealing, it becomes difficult to decrease the carbon to about 50 ppm or less, at which magnetic aging can be avoided. Accordingly, the carbon content must be about 0.08 mass percent or less. In terms of material properties, the carbon content has no lower limit and may be substantially 0 mass percent. However, about 1 ppm is regarded as an industrial limit for the carbon content.

Si content: about 2.0-8.0 mass percent

While Si increases the electrical resistance to improve iron loss effectively, such an effect cannot be sufficiently achieved with less than about 2.0 mass percent of Si. On the other hand, more than about 8.0 mass percent of Si reduces workability. Thus, the Si content should be about 2.0-8.0 mass percent.

Mn content: about 0.005-3.0 mass percent

While Mn is essential for improving hot-workability, such an effect cannot be sufficiently achieved with less than about 0.005 mass percent of Mn. On the other hand, more than about 3.0 mass percent of Mn reduces the magnetic flux density. Thus, the Mn content should be about 0.005-3.0 mass percent.

Al content: less than about 100 ppm; N, S, and Se contents: about 50 ppm or less each To achieve satisfactory secondary-recrystallization, the content of Al impurity should be less than about 100 ppm, and the content of S and Se impurities should be about 50 ppm or less each. Preferably, the Al content is about 20-100 ppm. This lower limit is determined in consideration of cost of reducing Al. Preferably, the contents of S and Se are about 45 ppm or less each.

Nitrogen content should be about 50 ppm or less to prevent the formation of silicon nitrides during the purification annealing. Preferably, the nitrogen content is about 50 ppm or less.

While lesser contents of these impurities are more preferred and thus may be 0 ppm, the industrial limit of reducing them is about 1 ppm.

Advantageously, other nitride-forming elements, such as Ti, Nb, B, Ta, and V are each reduced to about 50 ppm or less to prevent the deterioration of iron loss and to ensure excellent workability. Preferably, the Ti content is 20 ppm or less.

In addition to these essential elements and elements to be reduced, the following elements may be used as appropriate in the present invention.

The material may contain about 0.005-1.50 mass percent of Ni and/or about 0.01-1.50 mass percent of Cu to improve the hot-rolled sheet structure and the magnetic properties. Amounts of Ni and/or Cu below the respective lower limits will not improve the magnetic properties significantly, and amounts of Ni and/or Cu above the respective upper limits will result in unstable secondary-recrystallization and a deterioration in magnetic properties.

Furthermore, the material may contain a total of 0.0050-0.50 mass percent of As, Te, Sb, Sn, P, Bi, Hg, Pb, Zn, and/or Cd to improve the iron loss. Alternatively, the material may contain a total of 0.0050-0.50 mass percent of at least one of Cr, As, Te, Sb, Sn, P, Bi, Hg, Pb, Zn, and Cd. These elements at amounts below the lower limit in total will not improve the iron loss significantly, and at amounts above the upper limit will suppress the growth of secondary-recrystallization grain.

Preferably, the remainder of the material is iron and inevitable impurities. The inevitable impurities include the impurities described above and oxygen. The oxygen content is preferably about 40 ppm or less.

Then, molten steel that is adjusted to the optimum composition as described above is smelted in a converter, an electric furnace, or the like by conventional methods, is treated, for example, in vacuum if desired, and is processed by common ingot-making or continuous casting into a slab (a steel slab), or by direct casting into a thin slab with a thickness of about 100 mm or less.

The slab may be heated by conventional methods and hot-rolled, or alternatively, it may be hot-rolled immediately after casting without heating. The thin slab may be hot-rolled or may be subjected to the subsequent steps without hot-rolling.

Preferably, the temperature of the slab before hot-rolling is about 1250° C. or less to reduce scale during the hot-rolling. Furthermore, the slab is desirably heated to a lower temperature to eliminate harmful effects caused by the formation of a fine-grained crystal structure and by the contamination of inhibitor-forming components inevitably mixed into the slab, and to achieve a primary-recrystallization structure of uniform and sized grain. On the other hand, in view of the load on a hot-rolling line, the slab is usually heated to at least about 1000° C. Thus, the slab is preferably heated to about 1100-1250° C.

Then, annealing of the hot-rolled sheet is performed if desired; for example, the annealing allows a Goss structure in the final sheet product to develop highly.

Preferably, the annealing temperature of the hot-rolled sheet is about 800-1100° C. to achieve this effect. When the annealing temperature is less than about 800° C., a band structure during the hot rolling remains and thus the uniform and sized grain level in the primary-recrystallized structure is reduced. This causes insufficient growth in secondary-recrystallization. On the other hand, when the annealing temperature of the hot-rolled sheet exceeds about 1100° C., the grain size after the annealing will increase. This is not preferable in terms of achieving a uniform and sized grain in the primary recrystallization structure. More preferably, the temperature of the hot-rolled sheet is about 900-1100° C.

Cold-rolling is performed after the hot-rolling or the annealing of the hot-rolled sheet. The cold-rolling may be performed one time, or at least two times if desired. When the cold-rolling is performed more than once, intermediate annealing is typically performed between each cold-rolling. The conditions of the intermediate annealing may be in accordance with conventional methods. In a conventional process using a slab as a starting material, a cold-rolled steel sheet is strip-shaped.

In the cold-rolling, a rolling temperature of about 100-300° C. and/or one or more aging treatments at about 100-300° C. during the cold-rolling is advantageous to develop a Goss structure.

After the cold-rolling, decarburizing annealing is performed, if desired, to reduce the carbon content to about 50 ppm or less, preferably about 30 ppm or less, at which magnetic aging no longer occurs.

Preferably, the decarburizing annealing is performed at about 700-1000° C. in a wet atmosphere.

In addition, siliconization may be applied between the cold-rolling and secondary-recrystallization annealing to increase the Si content. Conveniently, siliconization is applied after decarburizing annealing.

Then, a MgO-based annealing separator is applied to the sheet, and finishing-annealing including secondary-recrystallization annealing and purification annealing is performed to develop a secondary-recrystallization structure and a forsterite film. Preferably, MgO is at least about 80 mass percent of the annealing separator.

Alternatively, another annealing separator based on an element other than MgO is used, if desired, to generate a non-forsterite film. Examples of such an annealing separator include those based on $Al_2O_3$ or $SiO_2$. Annealing separators may be omitted if desired.

Advantageously, secondary-recrystallization annealing is performed at about 800° C. or more on set of secondary-recrystallization. Since the heating rate to 800° C. does not significantly affect the magnetic properties, it may be determined arbitrarily. Preferably, the secondary-recrystallization annealing is performed at about 1050° C. or less. Particularly when soaking is performed, the temperature of the secondary-recrystallization annealing is preferably about 900° C. or less.

Preferably, the secondary-recrystallization annealing is performed for 10 hours or more in the temperature range described above. Thus, typically in finishing-annealing, a cold-rolled steel strip is wound in a coil and is subjected to batch annealing.

In the subsequent purification annealing, the annealing temperature is preferably about 1050° C. or more to generate a satisfactory forsterite film. An upper limit of the annealing temperature is about 1300° C. in view of cost. Preferably, the purification annealing is performed for 1-20 hours.

Furthermore, controlling the annealing atmosphere is important in the purification annealing to prevent deterioration in bend properties as follows:

for purification annealing temperatures of 1170° C. or less, adjust the hydrogen partial pressure in the atmosphere to about 0.8 atm or less in a temperature range of 1050° C. or more; and for purification annealing temperatures above 1170° C., adjust the hydrogen partial pressure in the atmosphere to about 0.4 atm or less in a temperature range above 1170° C.

When the hydrogen partial pressure exceeds about 0.8 atm in a temperature range of 1170° C. or less in the former, or exceeds about 0.4 atm in a temperature range above 1170° C. in the latter, voids will be formed at a grain boundary by hydrogen attack in transverse ends, which are highly sensitive to the atmosphere. Then, $N_2$ that is dissolved in the steel precipitates as silicon nitrides on the voids during cooling causing a deterioration of the bend properties. Accordingly, by providing an atmosphere having the hydrogen partial pressure defined above to at least transverse ends of the coil, deteriorations in the bend properties can be prevented.

When the purification annealing temperature is above 1170° C., the effect of atmosphere at 1050-1170° C. is relatively small, and thus there is no need to control the hydrogen concentration in this temperature range.

In view of avoiding explosion, the total pressure in an annealing furnace during purification annealing is preferably 1.0 atm or more. Preferably, the gas used to adjust the hydrogen partial pressure is an inert gas, such as Ar, Ne, and He. Nitrogen may also be used, but is not preferred because it may interfere with nitrogen removal from the steel. Thus, nitrogen is preferably less than 50%, more preferably less than 30%, still more preferably 15% or less, and most preferably substantially 0% by volume.

As described above, the steel may contain at least one of Cr, As, Te, Sb, Sn, P, Bi, Hg, Pb, Zn, and Cd to improve iron loss. However, high contents of these elements accelerate hydrogen attack. Thus, when the steel contains about 0.0050 mass percent or more of these elements in total, the conditions of the annealing atmosphere described above are preferably replaced with the following conditions:

for purification annealing temperatures of 1170° C. or less, adjust the hydrogen partial pressure in the atmosphere to about 0.6 atm or less in a temperature range of 1050° C. or more; and for purification annealing temperatures above 1170° C., adjust the hydrogen partial pressure in the atmosphere to about 0.2 atm or less in a temperature range above 1170° C.

When these elements that accelerate hydrogen attack exceed about 0.5 mass percent in total, the bend properties will not be improved. Therefore, these elements should be 0.5 mass percent or less.

As described above, secondary-recrystallization annealing and purification annealing are typically performed sequentially and are together referred to as finishing-annealing. Theoretically, secondary-recrystallization annealing and purification annealing may be performed independently in this order. In this case, an annealing separator may be applied before either annealing process.

After purification annealing, flattening annealing is performed, if desired, for shape correction. Advantageously, an insulating coating that generates tension on the surface of the steel sheet is further applied to improve iron loss. The flattening annealing, the tension-coating step, and their associated steps are herein referred to as a flattening step as a whole.

When finishing-annealing is performed on the coil in batch annealing, an electrical steel sheet exhibits excellent bend properties over the transverse direction of the coil. In other words, the bend properties after finishing-annealing are not deteriorated over the transverse ends. Thus, the bend properties of the ends are excellent after the finishing-annealing and the subsequent flattening step including flattening annealing. In addition, the stability of manufacturing line in the flattening step and the subsequent steps is also excellent.

In the composition (excluding a film, such as a forsterite film) of the electrical steel sheet, carbon is reduced to about 50 ppm or less, and S, Se, and Al are each reduced to about 15 ppm or less by purification treatment. Nitrogen is also reduced to about 35 ppm or less by the purification treatment (a typical analytical limit is about 5 ppm). Other components are similar to those of the slab.

EXAMPLES

Example 1

A steel slab that contained 0.050 mass percent of carbon, 3.25 mass percent of Si, 0.070 mass percent of Mn, 80 ppm of Al, 40 ppm of N, 20 ppm of S, and 20 ppm of Se, and consisted essentially of iron and inevitable impurities, was heated to 1200° C. and was hot-rolled into a coiled sheet with a thickness of 2.2 mm. The hot-rolled sheet was annealed at 1000° C. for 30 seconds, was subjected to removing scale on the surface, and was cold-rolled with a tandem mill to a final thickness of 0.28 mm. Then, the cold-rolled steel strip coil was degreased, was subjected to decarburizing annealing at 840° C. for 120 seconds, was coated with an annealing separator containing 90 mass percent of MgO and 10 mass percent of $TiO_2$, and was subjected to batch finishing-annealing to produce final sheet products.

In the finishing-annealing, the sheets were subjected to secondary-recrystallization annealing at 850° C. for about 50 hours, and were subjected to subsequent purification annealing including heating at 25° C./h to purification annealing temperatures shown in Table 1, and soaking at the temperature for 5 hours. The hydrogen partial pressure in the atmosphere was adjusted to values shown in Table 1 at temperatures above 1170° C. for purification annealing temperatures above 1170° C., and at 1050° C. or more for the purification annealing at 1170° C. or less. The atmosphere had a total pressure of 1.0 atm and was balanced with Ar.

Table 1 shows the magnetic properties ($B_8$: magnetic flux densities at a magnetizing force of 800 A/m) and bend properties of the resulting final sheet products. The final sheet products contained less than 15 ppm of carbon, Al, S, or Se.

The magnetic properties were measured at a position where the bend properties of the coils were evaluated. The bend properties were determined for a specimen 30 mm in width that was taken from a transverse end of the coil, specifically taken so that the center of the specimen being at a position 45 mm inside from an endmost portion, in accordance with a JIS C 2550 repeated bending test. A specimen that formed a crack within 5 times of bending was determined to be defective (The same applies to the following examples). Likewise, when the bend properties were also examined in the transverse center portions of the coils, the results were all excellent (not shown).

TABLE 1

| No. | Purification annealing temperature (° C.) | Hydrogen partial pressure (atm) | Residual nitrogen content (ppm) | Bend properties | Magnetic properties $B_8$(T) | Remarks |
|---|---|---|---|---|---|---|
| 1 | 1160 | 0 | 30 | Good | 1.89 | This invention |
| 2 | 1160 | 0.2 | 32 | Good | 1.90 | This invention |
| 3 | 1160 | 0.4 | 31 | Good | 1.90 | This invention |
| 4 | 1160 | 0.6 | 33 | Good | 1.89 | This invention |
| 5 | 1160 | 0.8 | 29 | Good | 1.91 | This invention |
| 6 | 1160 | 1.0 | 30 | Poor | 1.90 | Comparative example |
| 7 | 1170 | 0 | 28 | Good | 1.90 | This invention |
| 8 | 1170 | 0.2 | 25 | Good | 1.89 | This invention |
| 9 | 1170 | 0.4 | 29 | Good | 1.90 | This invention |
| 10 | 1170 | 0.6 | 33 | Good | 1.89 | This invention |
| 11 | 1170 | 0.8 | 30 | Good | 1.91 | This invention |
| 12 | 1170 | 1.0 | 32 | Poor | 1.90 | Comparative example |
| 13 | 1180 | 0 | 28 | Good | 1.90 | This invention |
| 14 | 1180 | 0.2 | 26 | Good | 1.89 | This invention |
| 15 | 1180 | 0.4 | 26 | Good | 1.90 | This invention |
| 16 | 1180 | 0.6 | 27 | Poor | 1.90 | Comparative example |

TABLE 1-continued

| No. | Purification annealing temperature (° C.) | Hydrogen partial pressure (atm) | Residual nitrogen content (ppm) | Bend properties | Magnetic properties $B_8$(T) | Remarks |
|---|---|---|---|---|---|---|
| 17 | 1180 | 0.8 | 29 | Poor | 1.89 | Comparative example |
| 18 | 1180 | 1.0 | 26 | Poor | 1.91 | Comparative example |

Table 1 shows that the specimens that meet our conditions exhibit excellent bend properties even at the transverse ends of the coils.

Example 2

Steel slabs that contained components shown in Tables 2-1 and 2-2, were substantially free of Se, and consisted essentially of iron and inevitable impurities as the remainder, were heated to 1200° C. and were hot-rolled into coiled sheets with a thickness of 2.2 mm. These hot-rolled sheets were annealed at 1000° C. for 30 seconds, were subjected to removing scale on the surface, were cold-rolled with a tandem mill to a final thickness of 0.28 mm, and were degreased. Then, the cold-rolled steel strips other than No. 42 steel were subjected to decarburizing annealing at 840° C. for 120 seconds. The steel strips were coated with an annealing separator containing 90 mass percent of MgO and 10 mass percent of $TiO_2$ (for No. 43 steel, an annealing separator consisting of $Al_2O_3$ was applied), and were subjected to batch finishing-annealing to produce final sheet products.

In the finishing-annealing, the strips were heated at 25° C./h from secondary-recrystallization annealing (850° C. for about 50 hours) to temperatures shown in Tables 2-1 and 2-2, and were subjected to the subsequent purification annealing at the temperature for 5 hours. The hydrogen partial pressure in the atmosphere was adjusted to values shown in Tables 2-1 and 2-2 at temperatures above 1170° C. for purification annealing temperatures above 1170° C., and at 1050° C. or more for the purification annealing at 1170° C. or less. The atmosphere had a total pressure of 1.0 atm and was balanced with Ar. However, the total pressure was 1.1 atm for No. 44 steel, and the balance gas was Ar and 10% by volume of nitrogen for No. 45 steel.

Tables 2-1 and 2-2 show the magnetic properties and bend properties of the resulting final sheet products. The final sheet products contained less than 15 ppm of carbon (other than No. 42 steel), Al, S, Se, or N.

Like example 1, Tables 2-1 and 2-2 show the bend properties of the coils at transverse ends. The bend properties at the transverse center portions of the coils were all excellent.

TABLE 2-1

| No. | C (mass %) | Si (mass %) | Mn (mass %) | sol.Al (ppm) | N (ppm) | S (ppm) | Sb (mass %) | Purification annealing temperature (° C.) | Hydrogen partial pressure (atm) | Bend properties | Magnetic properties $B_8$(T) | Remarks |
|---|---|---|---|---|---|---|---|---|---|---|---|---|
| 1 | 0.04 | 3.25 | 0.07 | 50 | 50 | 20 | 0.002 | 1180 | 0 | Good | 1.90 | This invention |
| 2 | 0.04 | 3.25 | 0.07 | 55 | 49 | 20 | 0.002 | 1180 | 0.2 | Good | 1.90 | This invention |
| 3 | 0.04 | 3.25 | 0.07 | 50 | 50 | 20 | 0.002 | 1180 | 0.4 | Good | 1.91 | This invention |
| 4 | 0.04 | 3.25 | 0.07 | 50 | 50 | 20 | 0.002 | 1180 | 0.6 | Poor | 1.88 | Comparative example |
| 5 | 0.04 | 3.25 | 0.07 | 48 | 50 | 20 | 0.002 | 1180 | 0.8 | Poor | 1.89 | Comparative example |
| 6 | 0.04 | 3.25 | 0.07 | 50 | 50 | 20 | 0.002 | 1180 | 1.0 | Poor | 1.89 | Comparative example |
| 7 | 0.04 | 3.25 | 0.07 | 47 | 50 | 20 | 0.002 | 1160 | 0 | Good | 1.90 | This invention |
| 8 | 0.04 | 3.25 | 0.07 | 50 | 50 | 20 | 0.002 | 1160 | 0.2 | Good | 1.91 | This invention |
| 9 | 0.04 | 3.25 | 0.07 | 53 | 50 | 20 | 0.002 | 1160 | 0.4 | Good | 1.89 | This invention |
| 10 | 0.04 | 3.25 | 0.07 | 50 | 50 | 20 | 0.002 | 1160 | 0.6 | Good | 1.90 | This invention |
| 11 | 0.04 | 3.25 | 0.07 | 52 | 50 | 20 | 0.002 | 1160 | 0.8 | Good | 1.88 | This invention |
| 12 | 0.04 | 3.25 | 0.07 | 50 | 50 | 20 | 0.002 | 1160 | 1.0 | Poor | 1.90 | Comparative example |
| 13 | 0.04 | 3.25 | 0.07 | 47 | 50 | 20 | 0.005 | 1180 | 0 | Good | 1.89 | This invention |
| 14 | 0.04 | 3.25 | 0.07 | 50 | 50 | 20 | 0.005 | 1180 | 0.2 | Good | 1.91 | This invention |
| 15 | 0.04 | 3.25 | 0.07 | 53 | 50 | 20 | 0.005 | 1180 | 0.4 | Poor | 1.90 | Comparative example |
| 16 | 0.04 | 3.25 | 0.07 | 50 | 50 | 20 | 0.005 | 1180 | 0.6 | Poor | 1.90 | Comparative example |

TABLE 2-1-continued

| No. | C (mass %) | Si (mass %) | Mn (mass %) | sol.Al (ppm) | N (ppm) | S (ppm) | Sb (mass %) | Purification annealing temperature (° C.) | Hydrogen partial pressure (atm) | Bend properties | Magnetic properties $B_8$(T) | Remarks |
|---|---|---|---|---|---|---|---|---|---|---|---|---|
| 17 | 0.04 | 3.25 | 0.07 | 53 | 50 | 20 | 0.005 | 1180 | 0.8 | Poor | 1.91 | Comparative example |
| 18 | 0.04 | 3.25 | 0.07 | 50 | 50 | 20 | 0.005 | 1180 | 1.0 | Poor | 1.89 | Comparative example |
| 19 | 0.04 | 3.25 | 0.07 | 47 | 50 | 20 | 0.050 | 1160 | 0 | Good | 1.90 | This invention |
| 20 | 0.04 | 3.25 | 0.07 | 53 | 50 | 20 | 0.050 | 1160 | 0.2 | Good | 1.88 | This invention |
| 21 | 0.04 | 3.25 | 0.07 | 50 | 50 | 20 | 0.050 | 1160 | 0.4 | Good | 1.90 | This invention |
| 22 | 0.04 | 3.25 | 0.07 | 47 | 50 | 20 | 0.050 | 1160 | 0.6 | Good | 1.89 | This invention |
| 23 | 0.04 | 3.25 | 0.07 | 50 | 50 | 20 | 0.050 | 1160 | 0.8 | Poor | 1.90 | Comparative example |
| 24 | 0.04 | 3.25 | 0.07 | 53 | 50 | 20 | 0.050 | 1160 | 1.0 | Poor | 1.88 | Comparative example |

TABLE 2-2

| No. | C (mass %) | Si (mass %) | Mn (mass %) | sol.Al (ppm) | N (ppm) | S (ppm) | Sb (mass %) | Purification annealing temperature (° C.) | Hydrogen partial pressure (atm) | Bend properties | Magnetic properties $B_8$(T) | Remarks |
|---|---|---|---|---|---|---|---|---|---|---|---|---|
| 25 | 0.04 | 3.25 | 0.07 | 50 | 50 | 20 | 0.050 | 1180 | 0 | Good | 1.90 | This invention |
| 26 | 0.04 | 3.25 | 0.07 | 50 | 50 | 20 | 0.050 | 1180 | 0.2 | Good | 1.88 | This invention |
| 27 | 0.04 | 3.25 | 0.07 | 47 | 50 | 20 | 0.050 | 1180 | 0.4 | Poor | 1.88 | Comparative example |
| 28 | 0.04 | 3.25 | 0.07 | 50 | 50 | 20 | 0.050 | 1180 | 0.6 | Poor | 1.89 | Comparative example |
| 29 | 0.04 | 3.25 | 0.07 | 53 | 50 | 20 | 0.050 | 1180 | 0.8 | Poor | 1.88 | Comparative example |
| 30 | 0.04 | 3.25 | 0.07 | 50 | 50 | 20 | 0.050 | 1180 | 1.0 | Poor | 1.88 | Comparative example |
| 31 | 0.04 | 2.10 | 0.07 | 60 | 45 | 20 | <0.001 | 1180 | 0 | Good | 1.90 | This invention |
| 32 | 0.04 | 7.80 | 0.07 | 60 | 45 | 20 | <0.001 | 1180 | 0 | Good | 1.86 | This invention |
| 33 | 0.04 | 3.25 | 0.01 | 90 | 35 | 20 | <0.001 | 1180 | 0 | Good | 1.91 | This invention |
| 34 | 0.04 | 3.25 | 2.55 | 90 | 35 | 20 | <0.001 | 1180 | 0 | Good | 1.90 | This invention |
| 35 | 0.03 | 3.00 | 0.05 | 65 | 25 | 20 | <0.001 | 1060 | 0.8 | Good | 1.89 | This invention |
| 36 | 0.05 | 3.50 | 0.10 | 65 | 25 | 20 | <0.001 | 1200 | 0.2 | Good | 1.88 | This invention |
| 37 | 0.04 | 3.25 | 0.07 | 92 | 45 | 20 | <0.001 | 1180 | 0 | Good | 1.90 | This invention |
| 38 | 0.04 | 3.25 | 0.07 | 80 | 23 | 20 | <0.001 | 1180 | 0 | Good | 1.90 | This invention |
| 39 | 0.04 | 3.00 | 0.07 | 70 | 30 | 40 | <0.001 | 1180 | 0 | Good | 1.88 | This invention |
| 40 | 0.04 | 3.00 | 0.07 | 70 | 30 | 50 | <0.001 | 1180 | 0 | Good | 1.87 | This invention |
| 41 | 0.07 | 3.00 | 0.07 | 85 | 35 | 20 | <0.001 | 1180 | 0 | Good | 1.90 | This invention |
| 42 | 0.003 | 3.00 | 0.07 | 80 | 40 | 20 | <0.001 | 1180 | 0 | Good | 1.89 | This invention |
| 43 | 0.04 | 3.25 | 0.07 | 60 | 30 | 20 | <0.001 | 1180 | 0.2 | Good | 1.90 | This invention |
| 44 | 0.03 | 3.25 | 0.06 | 75 | 45 | 20 | <0.001 | 1180 | 0.2 | Good | 1.89 | This invention |
| 45 | 0.03 | 3.50 | 0.06 | 75 | 50 | 20 | <0.001 | 1180 | 0.4 | Good | 1.89 | This invention |
| 46 | 0.03 | 3.25 | 0.06 | 75 | 40 | 20 | <0.001 | 1180 | 0.4 | Good | 1.89 | This invention |
| 47 | 0.03 | 3.25 | 0.06 | 75 | 45 | 20 | <0.001 | 1180 | 0.3 | Good | 1.88 | This invention |

Tables 2-1 and 2-2 show that the specimens that meet our conditions exhibit excellent bend properties even at the transverse ends of the coils. In particular, when 0.005 mass percent or more of Sb is contained, hydrogen in purification annealing is preferably limited to a lower level.

Example 3

Steel slabs that contained components shown in Table 3, were substantially free of Se, and consisted essentially of iron and inevitable impurities, were heated to 1200° C. and were hot-rolled into coiled sheets with a thickness of 2.2 mm. These hot-rolled sheets were annealed at 1000° C. for 30 seconds, were subjected to removing scale on the surface, were cold-rolled with a tandem mill to a final thickness of 0.28 mm. Then, the cold-rolled steel strip coils were degreased, were subjected to decarburizing annealing at 840° C. for 120 seconds, were coated with an annealing separator containing 90 mass percent of MgO and 10 mass percent of $TiO_2$, and were subjected to batch finishing-annealing to produce final sheet products.

In the finishing-annealing, the sheets were subjected to secondary-recrystallization annealing at 850° C. for about 50 hours, and were subjected to the purification annealing including subsequent heating at 25° C./h to 1160° C., and subsequent soaking at 1160° C. for 5 hours. The hydrogen partial pressure at 1050° C. or more was changed from 0 to 0.1 atm (total pressure: 1.0 atm) as shown in Table 3. The balance gas was Ar.

Table 3 shows the magnetic properties and bend properties of the resulting final sheet products. The final sheet products contained less than 15 ppm of carbon, Al, S, Se, or N.

Like example 1, Table 3 shows the bend properties of the coils at transverse ends. The bend properties at the transverse center portions of the coils were all excellent.

TABLE 3

| No. | C (mass %) | Si (mass %) | Mn (mass %) | sol.Al (ppm) | N (ppm) | S (ppm) | Sb (mass %) | P (mass %) | Cr (mass %) | Bi (mass %) | Other components (mass %) | Hydrogen partial pressure (atm) | Bend properties | Magnetic properties $B_8$(T) | Remarks |
|---|---|---|---|---|---|---|---|---|---|---|---|---|---|---|---|
| 1 | 0.04 | 3.25 | 0.07 | 50 | 50 | 20 | 0.02 | — | — | — | — | 0.2 | Good | 1.90 | This invention |
| 2 | 0.04 | 3.25 | 0.07 | 55 | 50 | 20 | 0.02 | — | — | — | — | 0.8 | Poor | 1.90 | Comparative example |
| 3 | 0.04 | 3.25 | 0.07 | 50 | 50 | 20 | — | 0.02 | — | — | — | 0.2 | Good | 1.91 | This invention |
| 4 | 0.04 | 3.25 | 0.07 | 50 | 50 | 20 | — | 0.02 | — | — | — | 1.0 | Poor | 1.88 | Comparative example |
| 5 | 0.04 | 3.25 | 0.07 | 48 | 50 | 20 | 0.02 | — | 0.02 | — | — | 0.6 | Good | 1.89 | This invention |
| 6 | 0.04 | 3.25 | 0.07 | 50 | 50 | 20 | — | — | — | 0.03 | — | 0.2 | Good | 1.89 | This invention |
| 7 | 0.04 | 3.25 | 0.07 | 47 | 50 | 20 | — | — | — | 0.03 | — | 1.0 | Poor | 1.90 | Comparative example |
| 8 | 0.04 | 3.25 | 0.07 | 50 | 50 | 20 | — | 0.30 | — | — | — | 0.2 | Good | 1.91 | This invention |
| 9 | 0.04 | 3.25 | 0.07 | 53 | 50 | 20 | 0.40 | 0.20 | — | — | — | 0.4 | Poor | 1.89 | Comparative example |
| 10 | 0.04 | 3.25 | 0.07 | 50 | 49 | 20 | — | — | — | 0.60 | — | 0.6 | Poor | 1.90 | Comparative example |
| 11 | 0.04 | 3.25 | 0.07 | 52 | 50 | 20 | 0.20 | 0.30 | — | — | — | 0.8 | Poor | 1.88 | Comparative example |
| 12 | 0.03 | 3.20 | 0.09 | 60 | 47 | 30 | — | — | — | — | As: 0.01, Te: 0.02, Hg: 0.01 | 0.6 | Good | 1.88 | This invention |
| 13 | 0.05 | 3.30 | 0.05 | 58 | 43 | 25 | — | — | — | — | Pb: 0.01, Zn: 0.01, Cd: 0.02 | 0.6 | Good | 1.88 | This invention |
| 14 | 0.04 | 3.30 | 0.07 | 60 | 30 | 20 | 0.03 | — | — | — | Ni: 0.1 | 0.2 | Good | 1.90 | This invention |
| 15 | 0.04 | 3.30 | 0.07 | 65 | 30 | 20 | 0.03 | — | — | — | Cu: 0.2 | 0.2 | Good | 1.89 | This invention |
| 16 | 0.04 | 3.30 | 0.07 | 70 | 30 | 20 | 0.03 | — | — | — | Ni: 0.7, Cu: 0.2 | 0.2 | Good | 1.90 | This invention |
| 17 | 0.04 | 3.30 | 0.07 | 80 | 45 | 20 | — | — | — | — | Sn: 0.4 | 0.2 | Good | 1.89 | This invention |
| 18 | 0.04 | 3.30 | 0.07 | 70 | 40 | 20 | — | — | — | — | Sn: 0.1 | 0.2 | Good | 1.89 | This invention |
| 19 | 0.04 | 3.30 | 0.07 | 90 | 45 | 20 | — | — | — | — | Sn: 0.05 | 0.2 | Good | 1.90 | This invention |

Table 3 shows that the specimens that meet our conditions exhibit excellent bend properties.

Example 4

A steel slab that had the same composition as that in EXAMPLE 1 was heated to 1200° C. and was hot-rolled into a coiled sheet with a thickness of 2.4 mm. This hot-rolled sheet was not annealed and the scale on the surface was removed. The sheet was cold-rolled with a tandem mill to a final thickness of 0.28 mm.

The cold-rolling was performed in two stages: the sheet was first rolled at 80° C. to 1.6 mm thickness followed by intermediate annealing at 1000° C. for 60 seconds, and was then rolled at 200° C.

Then, the sheet was degreased, was subjected to decarburizing annealing at 840° C. for 120 seconds, was coated with a MgO-based annealing separator, and was subjected to finishing-annealing to produce a final sheet product.

In the finishing-annealing, the sheet was heated at 12.5° C./h from at least 900° C. to 1160° C. and was held at 1160° C. for 5 hours. The heat treatment (i.e. heating) between about 900° C. and about 1050° C. corresponds to secondary-recrystallization annealing, and the subsequent heat treatment (i.e. heating and soaking) corresponds to purification annealing. In the annealing, a hydrogen partial pressure at 1050° C. or more was 0.6 atm (total pressure: 1.0 atm). The final sheet product contained less than 15 ppm of carbon, Al, S, Se, or N.

The bend properties of the resulting steel sheet at a transverse end and at a transverse center portion of the coil were both excellent. The magnetic flux density $B_8$ was 1.87 T.

INDUSTRIAL APPLICABILITY

Bend properties of, in particular, a final sheet product of a grain-oriented electrical steel sheet manufactured without using an inhibitor are improved. Thus, a grain-oriented electrical steel sheet with excellent film properties can be consistently provided.

The invention claimed is:

1. A method for manufacturing a grain-oriented electrical steel sheet, comprising the steps of:

rolling a steel slab containing 0.08 mass percent or less of carbon, 2.0-8.0 mass percent of Si, and 0.005-3.0 mass percent of Mn into a cold-rolled steel sheet;

subsequently performing decarburizing annealing of the cold-rolled steel sheet if desired;

subsequently applying an annealing separator to the cold-rolled steel sheet if desired;

performing secondary-recrystallization annealing of the cold-rolled steel sheet; and subsequently performing purification annealing of the cold-rolled steel sheet, wherein the steel slab contains less than 100 ppm of Al and not more than 50 ppm each of N, S, and Se and the remainder being Fe and inevitable impurities, the purification annealing is performed at 1050° C. or more, and the partial pressure of hydrogen in the atmosphere is adjusted to 0.4 atm or less in a temperature range above 1170° C. for a purification annealing conducted at a temperature above 1170° C., or 0.8 atm or less in a temperature range of 1050° C. or more for a purification annealing conducted at a temperature of 1170° C. or less.

2. A method for manufacturing a grain-oriented electrical steel sheet, comprising the steps of:

rolling a steel slab containing 0.08 mass percent or less of carbon, 2.0-8.0 mass percent of Si, and 0.005-3.0 mass percent of Mn, and further containing 0.005-1.50mass percent of Ni and/or 0.01-1.50 mass percent of Cu, into a cold-rolled steel sheet;

subsequently performing decarburizing annealing of the cold-rolled steel sheet if desired;

subsequently applying an annealing separator to the cold-rolled steel sheet if desired;

performing secondary-recrystallization annealing of the cold-rolled steel sheet; and subsequently performing purification annealing of the cold-rolled steel sheet, wherein the steel slab contains less than 100 ppm of Al and not more than 50 ppm each of N, S, and Se and the remainder being Fe and inevitable impurities, the purification annealing is performed at 1050° C. or more, and the partial pressure of hydrogen in the atmosphere is adjusted to 0.4 atm or less in a temperature range above 1170° C. for a purification annealing conducted at a temperature above 1170° C., or 0.8 atm or less in a temperature range of 1050° C., or more for a purification annealing conducted at a temperature of 1170° C. or less.

3. A method for manufacturing a grain-oriented electrical steel sheet, comprising the steps of:

rolling a steel slab containing 0.08 mass percent or less of carbon, 2.0-8.0 mass percent of Si, and 0.005-3.0 mass percent of Mn, and further containing a total of 0.0050-0.50 mass percent of at least one of Cr, As, Te, Sb, Sn, P, Bi, Hg, Pb, Zn, and Cd, into a cold-rolled steel sheet;

subsequently performing decarburizing annealing of the cold-rolled steel sheet if desired;

subsequently applying an annealing separator to the cold-rolled steel sheet if desired;

performing secondary-recrystallization annealing of the cold-rolled steel sheet; and subsequently performing purification annealing of the cold-rolled steel sheet, wherein the steel slab contains less than 100 ppm of Al and not more than 50 ppm each of N, S, and Se, the purification annealing is performed at 1050° C. or more, and the partial pressure of the hydrogen in the atmosphere is adjusted to 0.2 atm or less in a temperature range above 1170° C. for a purification annealing conducted at a temperature above 1170° C., or 0.6 atm or less in a temperature range of 1050° C. or more for a purification annealing conducted at a temperature of 1170° C. or less.

4. A method for manufacturing a grain-oriented electrical steel sheet, comprising the steps of:

rolling a steel slab containing 0.08 mass percent or less of carbon, 2.0-8.0 mass percent of Si, and 0.005-3.0 mass percent of Mn, and further containing a total of 0.0050-0.50 mass percent of at least one of As, Te, Sb, Sn, P, Bi, Hg, Pb, Zn, and Cd, into a cold-rolled steel sheet;

subsequently performing decarburizing annealing of the cold-rolled steel sheet if desired;

subsequently applying an annealing separator to the cold-rolled steel sheet if desired;

performing secondary-recrystallization annealing of the cold-rolled steel sheet; and subsequently performing purification annealing of the cold-rolled steel sheet, wherein the steel slab contains less than 100 ppm of Al and not more than 50 ppm each of N, S, and Se, the purification annealing is performed at 1050° C. or more, and the partial pressure of the hydrogen atmosphere is adjusted to 0.2 atm or less in a temperature range above 1170° C. for a purification annealing conducted at a temperature above 1170° C., or 0.6 atm or less in a temperature range of 1050° C. or more for a purification annealing conducted at a temperature of 1170° C. or less.

5. A method for manufacturing a grain-oriented electrical steel sheet, comprising the steps of:

rolling a steel slab containing 0.08 mass percent or less of carbon, 2.0-8.0 mass percent of Si, and 0.005-3.0 mass percent of Mn, and further containing 0.005-1.50 mass percent of Ni and/or 0.01-1.50 mass percent of Cu, and a total of 0.0050-0.50 mass percent of at least one of Cr, As, Te, Sb, Sn, P, Bi, Hq, Pb, Zn, and Cd, into a cold-rolled steel sheet;

subsequently performing decarburizing annealing of the cold-rolled steel sheet if desired;

subsequently applying an annealing separator to the cold-rolled steel sheet if desired;

performing secondary-recrystallization annealing of the cold-rolled steel sheet; and subsequently performing purification annealing of the cold-rolled steel sheet, wherein the steel slab contains less than 100 ppm of Al and not more than 50 ppm each of N, S, and Se, the purification annealing is performed at 1050° C. or more, and the partial pressure of hydrogen in the atmosphere is adjusted to 0.2 atm or less in a temperature range above 1170° C. for a purification annealing conducted at a temperature above 1170° C., or 0.6 atm or less in a temperature range of 1050° C. or more for a purification annealing conducted at a temperature of 1170° C. or less.

6. The method for manufacturing a grain-oriented electrical steel sheet according to any one of claims 1 to 4 and 5, wherein, as the annealing separator, a MgO-based annealing separator is applied to the cold-rolled steel sheet.

7. The method for manufacturing a grain-oriented electrical steel sheet according to any one of claims 1 to 4 and 5, wherein the rolling step comprises the substeps of:

hot-rolling the steel slab;

annealing the hot-rolled steel sheet if desired; and performing cold-rolling one time, or at least two times with intermediate annealing therebetween to produce the cold-rolled steel sheet.

8. The method for manufacturing a grain-oriented electrical steel sheet according to any one of claims 1 to 4 and 5, wherein the nitrogen content in the atmosphere is less than 50% by volume in the purification annealing.

9. The method for manufacturing a grain-oriented electrical steel sheet according to any one of claims 1 to 4 and 5, wherein the rolling comprises a cold-rolling substep of preparing a cold-rolled steel strip, and the cold-rolled steel strip is subjected to the secondary-recrystallization annealing and the purification annealing to produce a strip-shaped grain-oriented electrical steel sheet.

* * * * *